US010030393B2

(12) United States Patent
Spence et al.

(10) Patent No.: US 10,030,393 B2
(45) Date of Patent: Jul. 24, 2018

(54) MOUNT FOR A PANEL

(71) Applicants: Hardware And Glass Group Limited, NSW, Hong Kong (CN); Stainless Outdoors Limited, Northcote, Auckland (NZ)

(72) Inventors: John Scott Spence, Auckland (NZ); Wayne Edward Austin, Padstow Heights (AU)

(73) Assignees: Stainless Outdoors Limited, Auckland (NZ); Hardware and Glass Group Limited, Hong Kong (CN)

( * ) Notice: Subject to any disclaimer, the term of this patent is extended or adjusted under 35 U.S.C. 154(b) by 0 days.

(21) Appl. No.: 15/024,903

(22) PCT Filed: Sep. 29, 2014

(86) PCT No.: PCT/NZ2014/000209
§ 371 (c)(1),
(2) Date: Mar. 25, 2016

(87) PCT Pub. No.: WO2015/047109
PCT Pub. Date: Apr. 2, 2015

(65) Prior Publication Data

US 2016/0281366 A1 Sep. 29, 2016

(30) Foreign Application Priority Data

Sep. 27, 2013 (NZ) ..... 616060

(51) Int. Cl.
*E04H 1/00* (2006.01)
*E04F 11/18* (2006.01)

(52) U.S. Cl.
CPC ..... *E04F 11/1812* (2013.01); *E04F 11/1817* (2013.01); *E04F 11/1853* (2013.01)

(58) Field of Classification Search
CPC E04F 11/1812; E04F 11/1817; E04F 11/1853
USPC ..... 52/238.1, 204.71, 204.72, 204.69; 256/24, 25
See application file for complete search history.

(56) References Cited

U.S. PATENT DOCUMENTS 3,468,516 A * 9/1969 Jounot ..... E04F 11/1851 256/24
4,054,268 A * 10/1977 Sher ..... E04F 11/1851 256/24
7,584,588 B2 * 9/2009 Kim ..... E06B 3/5864 52/204.597
8,500,110 B2 * 8/2013 Allen ..... E04F 11/1851 269/297
9,127,474 B2 * 9/2015 Tinwala ..... E04H 17/16
(Continued)

FOREIGN PATENT DOCUMENTS

EP 1647663 6/2008
NZ 551096 9/2009

*Primary Examiner* — Basil S Katcheves
(74) *Attorney, Agent, or Firm* — Gable Gotwals

(57) ABSTRACT

This invention relates to a mount for a panel for use as a balustrade, such as a glass pane, comprising a body having at least one curved side surface and at least one clamping member configured to clamp an edge of the panel with respect to the body and having at least one adjacent side surface configured to cooperate with the curved surface of the body for pivoting the panel with respect to the body on actuation of at least one actuator.

9 Claims, 4 Drawing Sheets

(56) References Cited

U.S. PATENT DOCUMENTS

| | | | | |
|---|---|---|---|---|
| 9,169,640 | B2 * | 10/2015 | Jeffers | E04B 2/7422 |
| 9,366,382 | B2 * | 6/2016 | Bonomi | E04F 11/1853 |
| 2002/0195595 | A1 * | 12/2002 | Shepherd | E04F 11/1851 256/25 |
| 2010/0307082 | A1 | 12/2010 | Nash | |
| 2013/0036680 | A1 | 2/2013 | Noble | |

* cited by examiner

MOUNT FOR A PANEL

STATEMENT OF CORRESPONDING APPLICATIONS

This application is the United States National Phase of PCT Patent Application No. PCT/NZ2014/000209 filed 29 Sep. 2014, which claims priority to the provisional specification filed in relation to New Zealand Patent Application No. 616060 filed 27 Sep. 2013, the entire contents are incorporated herein.

TECHNICAL FIELD

The present invention relates to a mount for a panel. More particularly, the present invention relates to a mount for a panel such as a glass pane for use as a balustrade for example in pool fencing.

BACKGROUND ART

Known mounts for panels such as glass balustrades require clamping an edge of the panel in a fixed position via fasteners such as screws which pass through holes in the glass. Such fastener holes reduce the strength of the glass panels by reducing their structural integrity.

Known mounts for panels exist without the use of fastener holes by fixing both sides of the panel via a mechanical holding device. However these systems require adjustment from both sides of the panel which can be difficult in locations when access to one side of the panel is restricted, such as multi-storey buildings. In these situations scaffolding is needed to safely install the panel.

A further problem with known panel mounts is the difficulty in adjusting the vertical angle of the panels to accommodate an uneven support surface. In this situation packing is needed between one of the clamping members and on one side of the panel edge to alter the vertical angle of the panel before the edge of the panel is fixed by adjusting the fasteners. This procedure requires trial and error (and is therefore time consuming) to get the required vertical angle of inclination of the panel (particularly at the top edge of the panel whose position can be magnified by a small alteration of the position of the bottom edge of the panel. In addition the packing on one side of the panel can place stress on the panel edge being clamped which can result in damage to the panel itself.

PRIOR REFERENCES

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications may be referred to herein; this reference does not constitute an admission that any of these documents form part of the common general knowledge in the art, in New Zealand or in any other country.

OBJECTS OF THE INVENTION

It is an object of the invention to provide an improved mount for a panel that that addresses at least some of the problems of the prior art, such as those discussed above.

Alternatively, it is an object of the present invention to address the foregoing problems or at least to provide the public with a useful choice.

DISCLOSURE OF INVENTION

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

According to one aspect of the present invention there is provided a mount for a panel comprising:

a body; and at least one clamping member configured to clamp an edge of the panel wherein at least one side surface of the body is curved and at least one adjacent side surface of at least of clamping member is configured to cooperate with the curved surface of the body to provide for pivoting of the panel with respect to the body on actuation of at least one actuator.

Preferably, the body comprises a channel configured to hold the at least one clamping member.

Preferably, the body comprises a base configured for fixing to a support surface with at least one fixing means.

Preferably, the at least one actuator is two spaced actuators configured to abut the clamping member to actuate pivoting of the panel with respect to the body.

Preferably, the mount for a panel also comprises a gasket configured to provide a contact surface of the panel edge and positioned between the panel and the clamping members.

Preferably, the panel also comprises a pair of collar members configured to abut each side of the panel to stabilise an edge of the panel when clamped to the body.

Preferably, the mount for a panel also comprises at least one facia to cover access to the at least one actuator after the panel edge has been clamped.

According to another aspect of the present invention there is provided a method of fixing a panel with respect to a support surface, the method comprising the steps:

a. providing a body comprising at least one curved surface;
b. fixing the body to a support surface;
c. providing at least one clamping member configured to clamp an edge of the panel wherein at least one surface of one of the clamping members is configured to cooperate with the curved surface of the body;
d. placing an edge of a panel in the body;
e. clamping the edge of the panel with at least one actuator; and
f. pivoting of the panel with respect to the body via actuation of the at least one actuator.

Preferably, the method of fixing a panel with respect to a support surface also comprises the step:

g. repeating steps (a) to (f) with a second mount for a panel positioned along the edge of a panel at a distance from the first mount for a panel.

BRIEF DESCRIPTION OF FIGURES

The invention will now be described by way of example only and with reference to any one of the accompanying drawings in which.

DETAILED DESCRIPTION OF THE INVENTION WITH BEST MODES

Figure 1:
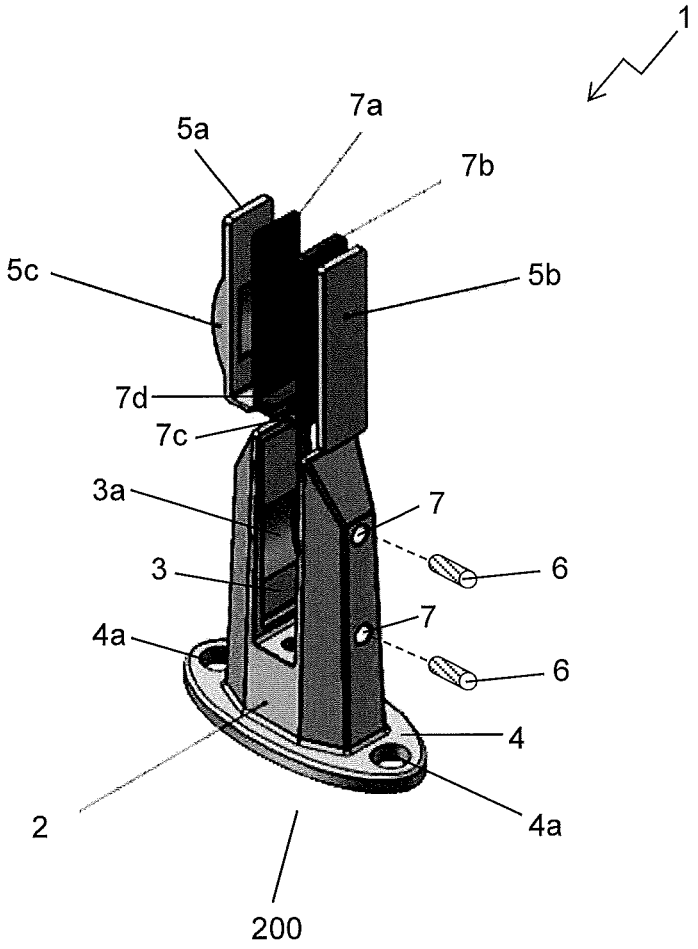
FIG. 1: shows a perspective exploded view of a first embodiment of the present invention in the form of a top fixed mount for a panel.
Figure 4:
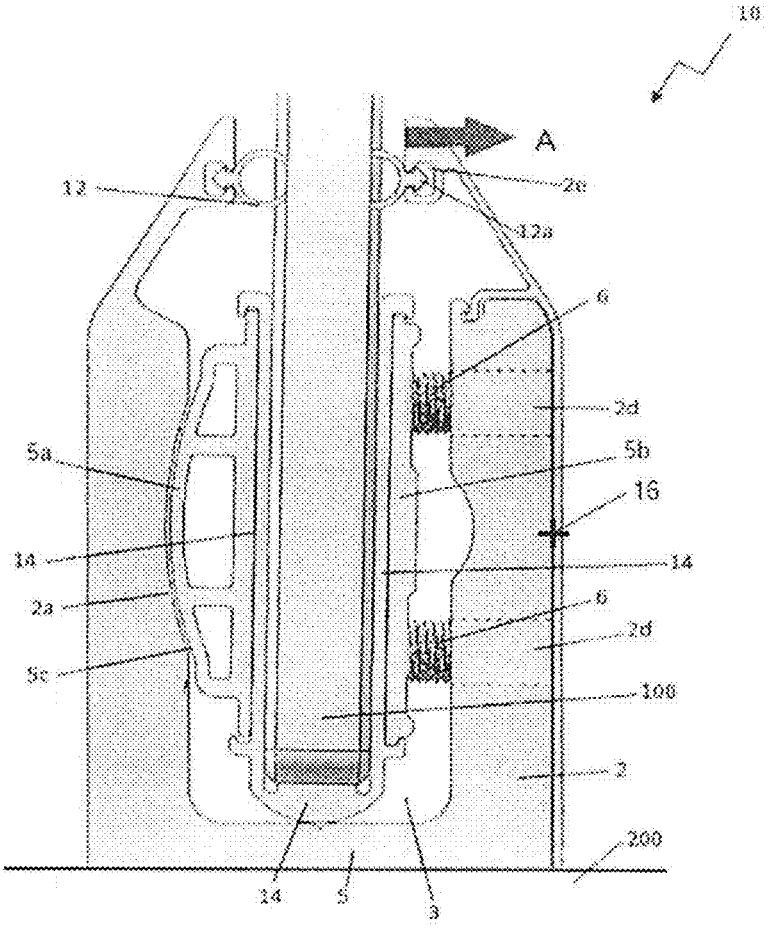
FIG. 4: shows a sectional side view of the embodiment shown in FIG. 3 with panel attached.

Referring to FIG. 1, a first preferred embodiment of the present invention in the form of a mount (generally indicated by arrow 1) for a panel (shown in FIG. 4 as 100) provides the capability of adjusting the vertical angle of inclination of the panel (100) with respect to a support surface (generally indicated by arrow 200) such as a floor after an edge of the panel 100 is received in the mount (1) but before fixing the panel (100) into position with respect to the support surface (200). The mount (1) can also provide for mounting from one side of the panel (100) when access is restricted from one side of the panel (100), such as on a multi-story building without the use of scaffolding.

The mount (1) comprises a body (2) defining a U-shaped, elongate channel (3). The body (2) comprises a base (4) configured for supporting the body (2) on a floor surface (100) by a fixing means such as screws passing through base apertures (4A).

A pair of clamping members in the form of pressure plates (5*a*, 5*b*) are housed in the channel (3) and configured to clamp an edge of the panel in the channel (3) on actuation of two spaced grub screws (6) positioned through a side wall of the body (2) via threaded apertures (7). One surface of the channel (3) is curved (3*a*). A curved surface (5*c*) of pressure plate (5*a*) cooperates with curved surface (3*a*) of the body (3) to allow for pivoting of the vertical position of a panel (100) with respect to the body (2) by differential adjustment of the grub screws (6) about pivot axis (16).

In this way, the vertical position of the panel (100) can be adjusted +/−3 mm (illustrated by arrow A in FIG. 4) which equates to the top of the panel (100) moving +/−30 mm to allow for support surfaces which are not level and obviate the need to pack the channel (3) on one side of a panel (100) which requires trial and error and can potentially damage the panel (100) edge.

The pressure plates (5*a*, 5*b*) are 70 mm in length to provide for distribution of pressure on a panel (100) once the grub screws (6) are tightened. The dimensions of the pressure plates (5*a*, 5*b*) can be varied without departing from the scope of the present invention.

The mount (8) also comprises a pair of gasket members (7*a*, 7*b*) configured to provide a contact surface of a panel (100) edge and positioned between the clamping members (5*a*, 5*b*) and a panel (100) to hold the pressure plates (5*a*, 5*b*) in place while the panel (100) is installed in the channel (3). The gasket members (7*a*, 7*b*) interlock via a male (7*c*) and female channel (7*d*) to provide stability to the gasket members (7*a*, 7*b*) in the channel to hold the pressure plates (5*a*, 5*b*) in place.

Figure 2:
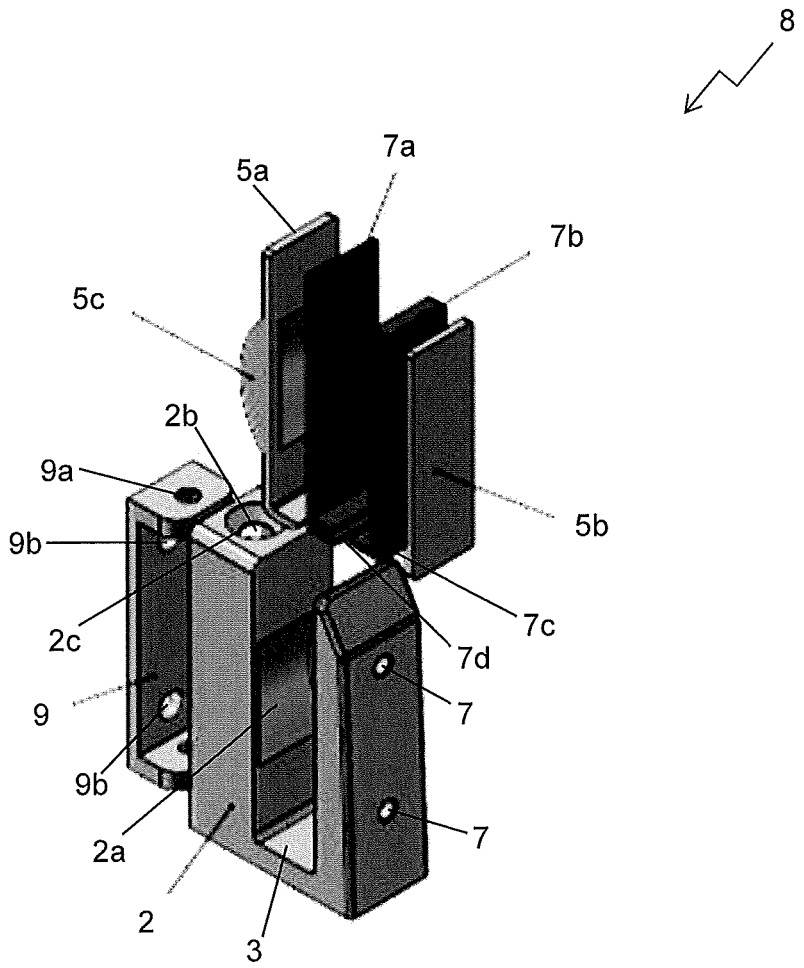
FIG. 2: shows a perspective exploded view of a second embodiment of the present invention in the form of a side fixed mount for a panel.

FIG. 2 shows a variant (8) of the preferred embodiment shown in FIG. 1 which comprises a side plate (9) configured to attach to a side surface such as a vertical wall rather than a horizontal floor. The side plate (9) is attached to the body (2) by being configured to channel within the body (2) via a body recess (2B) and be secured with respect to the body (2) via a screw (not shown) passing through body aperture (2*c*) and side plate aperture (9*a*). Without departing from the scope of the present invention, the side plate (9) can also be attached to the body (2) by snap lock fitting via tabs (not shown) extending from the side plate (9) which bias against the body recess (2B).

Figure 3:
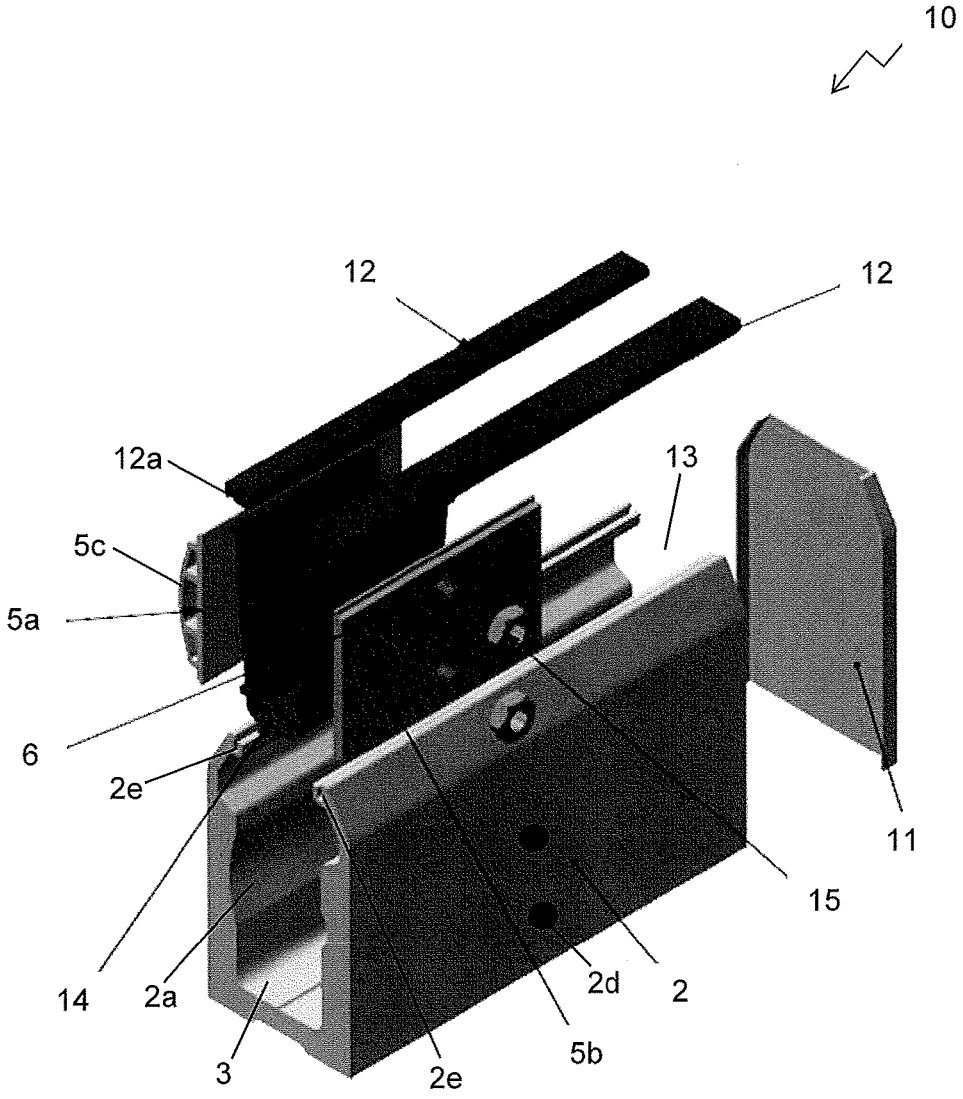
FIG. 3: shows a perspective exploded view of a third embodiment of the present invention in the form of a internally fixed mount for a panel.

Referring to FIG. 3, a mount (10) can also comprise a detachable facia (11) to cover access to the channel (3) after the panel (100) has been clamped to improve the aesthetic look of the mount (10) after installation and improve weather tightness by preventing the egress of water into the channel (3).

A pair of collar members can be positioned at a top opening (13) of the channel (3) in the form of two rubber strips (12) which attach to the body (2) via lugs (12*a*) which fit into recesses (2*e*) and which are attached to a one-piece gasket member (14) to abut each side of a panel (100) to stabilise the panel (100) when the edge of the panel (100) is placed in the channel (3).

The mount (1) is configured for applications where the body is received into the support surface such as in concrete or timber decks by comprising internally accessed grab screws (6) which pass through pressure plate (5*b*) and body apertures (2*d*) and which can be fixed via bolts (15).

The internal width of the channel (3) of the body (2) allows the mount (1, 8, 10) to accommodate varying thicknesses of panel (100) without having to use different sizes of mounts (1, 8, 10) for different thicknesses of panel (100). Tightening the grub screws (6) compresses the pressure plates (5*a*, 5*b*) onto varying thicknesses of panel (100).

In use, the panel (100) is fixed with respect to the support surface according to the following steps:

- fixing the body (2) to a support surface (not shown) via fasteners such as screws (not shown);
- placing the edge of a panel (not shown) in the channel (3);
- clamping the edge of the panel (100) on actuation of the grub screws (6); and
- pivoting of the panel (100) with respect to the body (2) via differential actuation of the grub screws (6); and
- repeating the preceding steps with a second mount positioned along the edge of the panel (100) at a distance from the first mount (10).

Advantages

The present invention offers the notable advantage over the prior art including:

- improved ease of use in mounting a panel on a support surface where access is restricted from one side of the panel;
- improved ease of use in adjusting the vertical position of the panel in relation to the once mounted; and
- accommodation of panels of varying thicknesses which obviates the need for different mounts for different panels thereby saving cost.

Variations

The invention may also be the broadly to consist in the parts, elements and features referred to or indicated in the specification of the application, individually or collectively, in any or all combinations of two or more of the parts, elements or features. Where in the foregoing description reference has been made to integers or components having known equivalents thereof, those integers are herein incorporated as if individually set forth.

It will of course be realised that while the foregoing has been given by way of illustrative example of this invention, all such and other modifications and variations thereto as would be apparent to persons skilled in the art are deemed to fall within the broad scope and ambit of this invention as defined in the appended claims.

Aspects of the present invention have been described by way of example only and it should be appreciated that modifications and additions may be made thereto without departing from the scope thereof as defined in the following claims.

What is claimed:

1. A mount for a panel comprising:

a body including two adjustable actuators spaced apart vertically on a first side of the body and located opposite a curved inner wall portion of a second side of the body spaced apart from the first side, each actuator having a substantially horizontal axis, the curved inner wall portion being located on the second side of the body, and wherein at least a part of the curved inner wall portion is located vertically between the axes of the two adjustable actuators; and at least one clamping member configured to clamp an edge region of the panel and including an outer wall portion configured to cooperate with said curved inner wall portion of the second side of the body by contacting the curved inner wall portion at one or more points vertically between the axes of the two adjustable actuators to provide for pivoting of the panel with respect to the body on differential actuation of the two adjustable actuators about a pivot axis located vertically between the axes of the two actuators.

2. The mount for a panel as claimed in claim 1, wherein the body comprises a channel configured to hold the at least one clamping member.

3. The mount for a panel as claimed in claim 1, wherein the body comprises a base configured for fixing to a support surface with at least one fixing means.

4. The mount for a panel as claimed in claim 1, wherein the two actuators are configured to abut the at least one clamping member to actuate pivoting of the panel with respect to the body.

5. The mount for a panel as claimed in claim 1, wherein the mount comprises a gasket configured to provide a contact surface for the panel edge region and positioned between the panel and the at least one clamping members.

6. The mount for a panel as claimed in claim 1, wherein the mount comprises a pair of collar members configured to abut each side of the panel to stabilise the panel when the panel is placed in the channel.

7. The mount for a panel as claimed in claim 1, wherein the mount also comprises at least one facia to cover access to the two actuators after the panel edge region has been clamped.

8. A method of fixing a panel with respect to a support surface, the method comprising the steps:

a. providing a body comprising two adjustable actuators spaced apart vertically on a first side of the body and located opposite a curved inner wall portion of a second side of the body spaced apart from the first side, each actuator having a substantially horizontal axis, the curved inner wall portion located on the second side of the body, and wherein at least a part of the curved inner wall portion is located vertically between the axes of the two adjustable actuators;

b. fixing the body to a support surface;

c. providing at least one clamping member configured to clamp an edge region of the panel, the at least one clamping member including an outer wall portion configured to cooperate with said curved inner wall portion of the second side of the body by contacting the curved inner wall portion at one or more points vertically between the axes of the two adjustable actuators to provide for pivoting of the panel with respect to the body about a pivot axis located vertically between the two actuator on actuation of the adjustable actuators;

d. placing an edge of a panel in the body;

e. clamping the edge of the panel with the two actuators; and f. pivoting the panel with respect to the body via adjustment of the two actuators.

9. The method of fixing a panel with respect to a support surface as claimed in claim 8 wherein, the method of fixing a panel with respect to a support surface also comprises the step:

g. repeating steps (a) to (f) with a second mount for a panel positioned along the edge of a panel at a distance from the first mount.

* * * * *